United States Patent [19]

Gertsch

[11] 4,314,714

[45] Feb. 9, 1982

[54] SAFETY SKI BINDING

[75] Inventor: Ulrich Gertsch, Brungasse 92, 3800 Matten, Interlaken, Switzerland

[73] Assignees: Ulrich Gertsch, Matten b. Interlaken; Ernst Gertsch, Wengen, both of Switzerland

[21] Appl. No.: 63,834

[22] Filed: Aug. 6, 1979

[30] Foreign Application Priority Data

Aug. 24, 1978 [CH] Switzerland ..... 8974/78

[51] Int. Cl.[3] ..... A63C 9/082

[52] U.S. Cl. ..... 280/630; 280/605; 280/618; 280/635

[58] Field of Search ..... 280/618, 620, 630, 633, 280/636, 626, 627, 629, 623, 611, 624, 605, 11.3, 11.31

[56] References Cited

U.S. PATENT DOCUMENTS

| | | | |
|---|---|---|---|
| 2,676,813 | 4/1954 | Beyl | 280/618 X |
| 3,764,155 | 10/1973 | Perryman | 280/618 |
| 3,998,475 | 12/1976 | Eckart | 280/623 |
| 4,185,852 | 1/1980 | Himmetsberger | 280/618 |

FOREIGN PATENT DOCUMENTS

| | | | |
|---|---|---|---|
| 953234 | 3/1964 | United Kingdom | 280/635 |

*Primary Examiner*—Joseph F. Peters, Jr.
*Assistant Examiner*—D. W. Underwood
*Attorney, Agent, or Firm*—Werner W. Kleeman

[57] ABSTRACT

A safety ski binding having an automatic heel release binding which releases when the skier suffers a frontal fall and a front jaw or front release binding which releases when the skier experiences a torsional fall. The automatic heel release binding is secured to the rear end of a release plate connected by means of a pivot pin with the ski and freely pivotable to both sides. The front jaw is anchored in spaced relationship forwardly of the release plate at the ski. At the region of its front end the release plate is provided with two, oppositely situated, substantially L-shaped entrainment elements, attached by one leg to be pivotable about a related shaft at the release plate. In the normal skiing position of the release plate the entrainment elements are retained in their effectual position, by bearing upon the ski, and the other leg of each entrainment element protrudes upwardly from the release plate and bears snugly at the ski boot which has been placed into the safety ski binding. As soon as during such rocking movement an entrainment element no longer bears upon the ski, then it is tilted over downwardly into its release position, so that the ski boot is freed and can detach from the release plate. Thereafter, by virtue of the action of resilient or spring rods, biased during the rocking of the release plate, the latter is again pivoted back towards its normal skiing position, with the result that the previously tilted over entrainment element again is moved back into its effectual position.

13 Claims, 11 Drawing Figures

28
30
31a
31
29

11
27
3e
3
1
4

11
27
1
3
2
4

SAFETY SKI BINDING

This application is related to the commonly assigned copending application Ser. No. 048,659, filed June 14, 1979, and now abandoned.

BACKGROUND OF THE INVENTION

The present invention relates to a new and improved construction of safety ski binding which is of the type comprising a heel holder and a sole holder, one of the holders being fixedly arranged at the ski and the other holder being secured to a release or sole plate fixed at the ski. The release plate can laterally pivot or rock, out of its normal skiing position, when the skier experiences a torsional fall. This release plate is equipped with an entrainment arrangement which coacts with the ski boot.

With the ski binding known to the art from U.S. Pat. No. 3,764,155, the release plate, provided with a heel holder and an entrainment device for the ski boot, and which release plate can rock to both sides, engages, in the normal skiing position of such release plate, by means of a tooth in a tooth gap of a sole holder. The sole holder, when the skier experiences a torsional fall, is laterally rocked or pivoted, and thus, releases the release plate, whereupon the ski boot can detach from the ski binding. This coupling action between the release plate and the sole holder is associated with the drawback that the bending behavior of the ski, during skiing, is appreciably impaired by the ski binding, producing a deformation in the lengthwise direction of the ski, which, in turn, has been found to be extremely disadvantageous, especially during excessive bending-through of the ski. Until, in the presence of a torsional fall, the ski boot is capable of completely releasing from the sole holder and also from the release plate, it is necessary for the release plate to move through a relatively large pivotal path. Consequently, the release of the ski boot is correspondingly delayed. Additionally, the release plate must be manually returned into its normal skiing position, before the skier can again step into the safety ski binding.

SUMMARY OF THE INVENTION

It is therefore a primary object of the present invention to provide a new and improved construction of safety ski binding which avoids the aforementioned drawbacks and limitations of the prior art constructions of safety ski bindings of the release plate type.

Still a further significant object of the present invention is to devise a safety ski binding of the previously mentioned type, which, while avoiding the aforementioned disadvantages, effectively affords complete release of the ski boot, in the presence of a torisonal fall of the skier, already after the release plate has moved through a small pivot or rock angle, and furthermore, does not require any manual return of the release plate into its normal skiing position.

A further important object of the present invention is to provide a safety ski binding of the character described wherein the release plate automatically resets into its normal skiing position, following release of the ski boot, and furthermore, the boot entrainment arrangement for retaining the ski boot upon the release plate equally is returned, following the ski boot release action, into its ski boot-entrainment position during return of the release plate back into its normal skiing position.

Another and noteworthy object of the invention is aimed at providing a new and improved construction of safety ski binding of the releasable plate type, which is simple in design, easy to handle and use, does not require any manual resetting of the release plate, is not prone to malfunction or breakdown, and generally is affected as little as possible by bending of the ski, thereby insuring for reliable and faultless release of the ski boot when the skier experiences a fall.

Now in order to implement these and still further objects of the invention, which will become more readily apparent as the description proceeds, the safety ski binding of the present development is manifested by the features that the release plate, which in its normal skiing position is decoupled from the ski fixedholder, following the pivoting movement of the release plate, is returned back into the normal skiing position by a return or restoring device. Advantageously, the entrainment arrangement is movably connected with the release plate and, following the outward pivoting of the release plate, is movable out of its effectual position, where it retains the ski boot at the release plate, into a release position where it frees the ski boot so that it can move off of the release plate.

By virtue of the provision of the entrainment arrangement there is insured for a connection between the ski boot and the release plate, so that prior to and during a release action, initiated by a torsional fall of the skier, no relative or no appreciable relative movement can occur between the release plate and the ski boot. Upon completion of the release action of the ski boot from the release plate, the entrainment arrangement is moved into ski boot-release position. Now the ski boot can move relative to the release plate and, directly following the release action, can positively release from the safety ski binding. Since the release plate need only pivot or rock through a relatively small angle, in order to completely release the ski boot, it is possible to insure, at any time, a positive return of the release plate back into its normal skiing position by providing a simply constructed return or restoring device.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
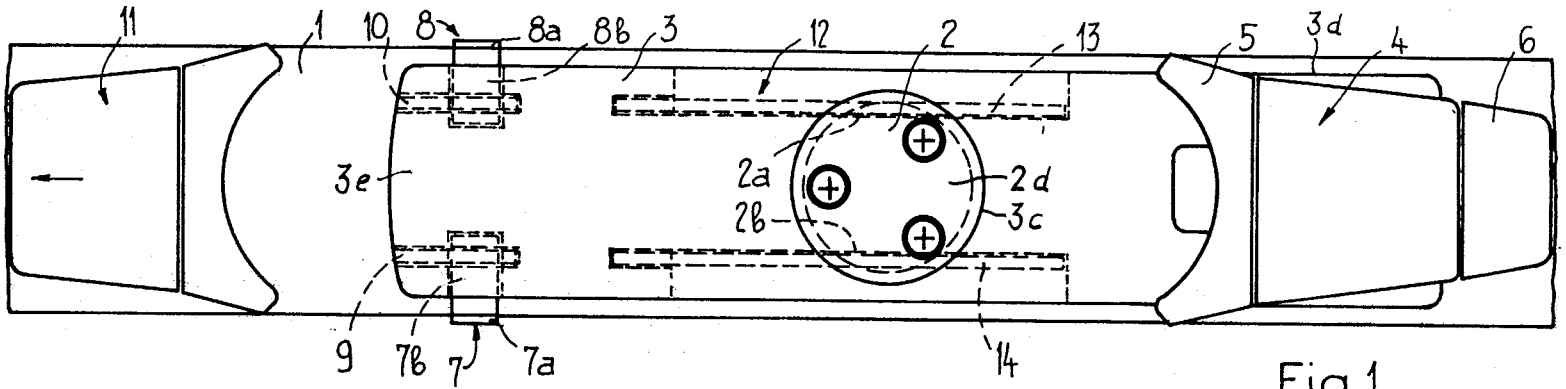
FIG. 1 is a top plan view of a first exemplary embodiment of a safety ski binding illustrating the release plate in its normal skiing position.

Describing now the drawings, it is firstly mentioned that throughout the various Figures there have been generally used the same reference characters to denote the same or analogous components for the different embodiments. Turning attention now to the exemplary embodiment of safety ski binding shown in FIGS. 1 and 2, it will be recognized that a release plate 3 is pivotably mounted upon a ski 1 by means of a substantially cylindrical pivot pin 2 or equivalent structure which is attached at the ski 1. This pivot pin or pivot means 2 enables lateraly rocking or outward pivoting of the release plate 3, however prevents lift-out of the release plate 3 from the ski 1. This can be easily accomplished by a number of different techniques, such as providing a stepped bore 3*c* in the release plate 3 which receives an enlarged head portion 2*d* of the pivot pin 2, so that when the latter is attached, for instance threaded at the ski 1, the release plate 3 is pivotably mounted at such ski 1. An automatic heel release binding 4 is attached, for instance by being screwed or otherwise secured, at the rear end 3*d* of the release plate 3. This automatic heel release binding 4, hereinafter usually referred to also as an automatic heel step-in binding, is adjustable in the lengthwise direction in order to provide a lengthwise adjustment thereof so as to accommodate different size ski boots. Such automatic heel release binding or heel step-in binding 4, which performs a release action when the skier suffers a frontal fall, is of conventional construction, so that there is no need to describe its construction and mode of operation in detail, since it is well known in the skiing art. Moreover, this automatic heel step-in binding 4 possesses a heel holder or heel holddown 5 which engages over the sole of the ski boot. The heel holddown or holder 5, in the presence of a frontal fall of the skier, rocks upwardly, and thus, releases the heel of the ski boot. By means of a release or unlocking lever 6 or equivalent structure, it is possible to open the automatic heel step-in binding 4 in order to permit the skier to conveniently step into and out of the binding.

At the end of end region 3*e* of the release plate 3, positioned opposite the automatic heel step-in binding 4, this release plate 3 carries an entrainment arrangement or entrainment means, here shown in the form of two entrainment elements 7 and 8 whose lengthwise axes are situated opposite one another, as best seen by referring to FIG. 1. These entrainment elements 7 and 8 coact with the ski boot for holding the latter upon the release plate 3 during the normal skiing position. Each of the entrainment elements 7 and 8 has a substantially L-shaped configuration and incorporates the legs 7*a*, 7*b* and 8*a*, 8*b*, respectively. The one leg or leg member 7*a* and 8*a* of each of the corresponding substantially L-shaped entrainment elements 7 and 8, extends upwardly from the release plate 3 and snugly bears laterally at the sole of the ski boot, so that a connection, essentially free of play, exists between the ski boot and the release plate 3. The other leg 7*b* and 8*b* of the entrainment elements 7 and 8, respectively, is connected with an axle or shaft 9 and 10, respectively. These shafts 9 and 10 extend essentially parallel to the lengthwise direction of the release plate 3 and are rotatably mounted therein. In the normal skiing position—sometimes also referred to simply as the normal position—of the release plate 3, shown in FIG. 1, the legs or leg members 7*b* and 8*b* of the entrainment elements 7 and 8, respectively, bear upon the ski 1, so that these entrainment elements 7 and 8 are retained in their effectual position where, as already mentioned, the other legs 7*a* and 8*a* extend upwardly and bear against the sole of the ski boot.

Arranged in spaced relationship from and forwardly of the release plate 3 is a releasable toe holder 11, usually referred to hereinafter as a front jaw, which is suitable attached, as by threading or bolting, at the ski 1. This front jaw 11, likewise of conventional construction and commercially available in the market place, and therefore, need not here be further described, as is well known in the ski binding art engages over the sole of the ski boot at the tip thereof and releases when the skier encounters a torsional fall. However, the front jaw 11 also can be designed so that it accomplishes a release action when the skier encounters a rearward or backward fall. Between the release plate 3 and the front jaw 11 there is no mechanical coupling. The connection between this front jaw 11 and the release plate 3 occurs by the ski boot when it is placed into the safety ski binding.

Figure 2:
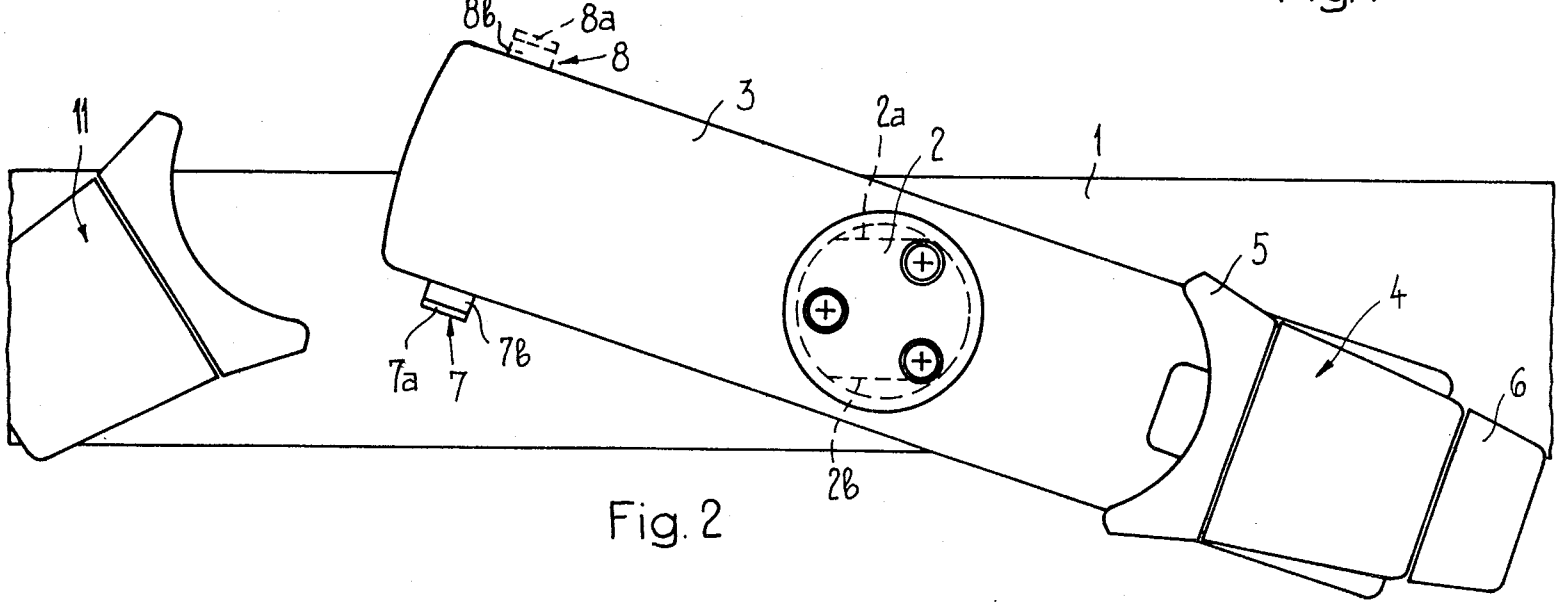
FIG. 2 is a view, similar to the showing of FIG. 1, illustrating the release plate of the safety ski binding in its pivoted-out or release position.

Operatively engaging with the release plate 3 is a return or restoring device 12 which, as a matter of convenience in illustration, has not been particularly shown in FIG. 2 but illustrated in detail in FIG. 1. This return or restoring device 12 serves for the automatic resetting of the release plate 3 into its normal skiing position. This return device or return means 12 will be seen to comprise two resilient or spring rods 13 and 14 which extend essentially parallel to the lengthwise direction of the release plate 3. The resilient or spring rods 13 and 14 are anchored, in the embodiment under discussion, at both of their ends in the release plate 3, although, as will be explained hereinafter, these spring rods 13 and 14 can also be connected differently, for instance secured at the ski 1. Each spring rod 13 and 14, in the normal position of the release plate 3, bears against a flat or beveled portion 2*a* and 2*b* of the pivot pin 2. By the action of such spring rods 13 and 14 the release plate 3 is retained in its normal skiing position, so that the ski binding is in a state where the skier can step into the same at any time.

When the skier experiences a frontal fall, then, as already mentioned, the automatic heel step-in binding 4 releases, and consequently, frees the ski boot from the release plate 3. When the skier experiences a torsional fall, causing release of the front jaw 11, the latter is laterally rocked or pivoted, as shown in FIG. 2. Due to the laterally outwardly pivoting motion of the ski boot which is connected with the entrainment elements 7 and 8, as explained above, also the release plate 3 together with the automatic heel step-in binding 4 is rocked out of its normal skiing position, this having been likewise shown in FIG. 2. Now as soon as during the course of such pivoting or rocking movement the leg 8*b* or 7*b*, as the case may be, of the related entrainment element 8 and 7, respectively, no longer bears upon the top surface of the ski 1, then the relevant entrainment element 8 or 7 pivots downwardly about its related shaft 10 or 9, respectively, so that the other leg 8*a* or 7*a* can release from the ski boot sole. Consequently, the entrainment connection between the release plate 3 and the ski boot is eliminated and the ski boot now can completely release from the ski binding. During such pivoting movement of the release plate 3 the spring rods 13 and 14 of the return device 12 are deflected by the pivot pin 2, and thus such spring rods 13 and 14 are pre-biased or stressed. Now as soon as the ski boot has completely detached from the binding, the pre-biased resilient or spring rods 13 and 14 cause an immediate return of the release plate 3 into its normal skiing position. The entrainment element 8 or 7, as the case may be, which as described has been rocked downwardly into its release position, now can again rock into its effectual position, by virtue of the return movement of the release plate 3, since such previously downwardly rocked entrainment element 8 or 7 again bears at the top surface of the ski 1. Hence, the ski binding, following the release action, again is immediately ready to be stepped into by the skier, without there being required any additional manual operations.

Figure 3:
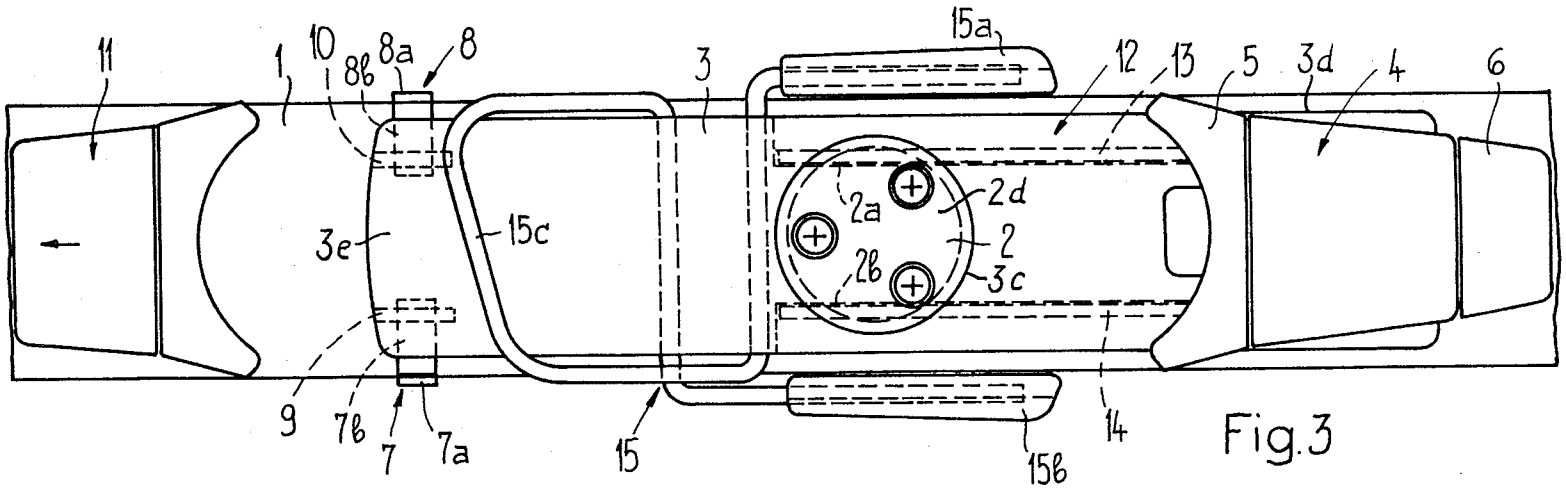
FIG. 3 is a top plan view of a further embodiment of safety ski binding showing the release plate in its normal skiing position.

Since the ski boot is completely released, due to the flopping over of the entrainment elements 7 and 8, already after a small pivotal path of the release plate 3, it is possible, with a simply constructed return device 12, to insure for a faultless resetting of the release plate 3 at any point in time. This positive resetting action is particularly then of significance if, as shown in FIG. 3, a ski brake 15 is incorporated into the release plate 3. This ski brake 15 is of conventional design and as shown in FIG. 3, which in all other respects corresponds to the safety ski binding of FIG. 1, has been portrayed in its normal skiing position. Thus, the ski brake 15 is retained in its normal skiing position, by the action of the ski boot which has been placed into the binding, and thus, exerts a force upon the front part 15*c* of the ski brake 15. Both of the drag or brake legs 15*a* and 15*b* of the ski brake 15 thus extend laterally of the ski 1 in its lengthwise direction. But as soon as the ski boot has been released from the release plate 3, then the ski brake 15, which is under spring tension, automatically shifts into its ski braking position, where now the drag or brake legs 15*a* and 15*b* depend downwardly and extend past the running surface of the ski, so as to prevent any further sliding of the ski 1. However, this shifting of the ski brake 15 into its brake position can only then occur when the release plate 3 is located in its normal skiing position. Therefore, it is of importance that the release plate 3, following the release action, be returned as quickly and faultlessly as possible back into its normal skiing position. Since, as mentioned, owing to the entrainment elements 7 and 8 tilting into their release position there is possible release of the ski boot already directly after the release action, the release plate 3 need only be pivoted or rocked through a small angle of, for instance, 5°, so that the resetting of the release plate 3 can be accomplished without any problem and there is insured for the proper functioning of the ski brake 15.

Figure 4:
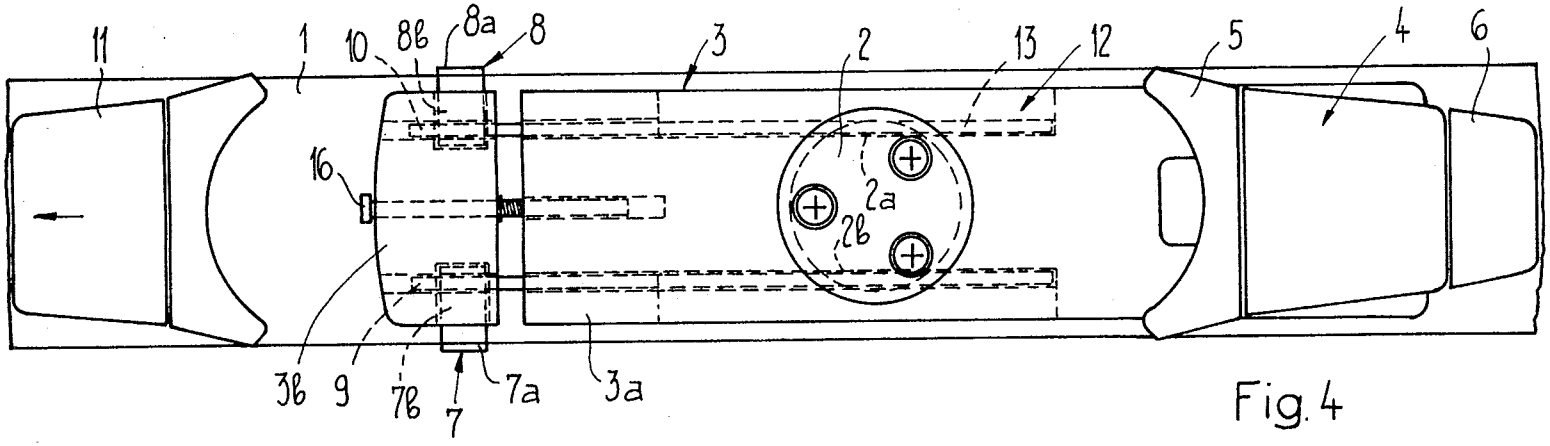
FIG. 4 is still a further embodiment of safety ski binding illustrating the release plate in its normal skiing position.

With the exemplary embodiment of safety ski binding shown in FIG. 4, corresponding in construction and mode of operation extensively completely to the embodiment of FIGS. 1 and 2, the release plate 3 consits of two parts or components 3*a* and 3*b* which can be adjusted relative to one another in the lengthwise direction of the release plate 3. The part 3*a* is connected by means of the pivot pin 2 with the ski 1. The part 3*b*, displaceable relative to the ski fixed-part 3*a*, is provided with the entrainment elements 7 and 8. This part 3*b* is displaceably guided upon the shafts 9 and 10 of the entrainment elements 7 and 8, respectively, which are anchored at the part 3*a*. Adjustment of the part 3*b* is accomplished by means of an adjustment screw 16 or equivalent structure which engages in the other part 3*a*. By adjusting the part 3*b* it is possible to accommodate the length of the safety ski binding to different ski boot sizes.

Figure 5:
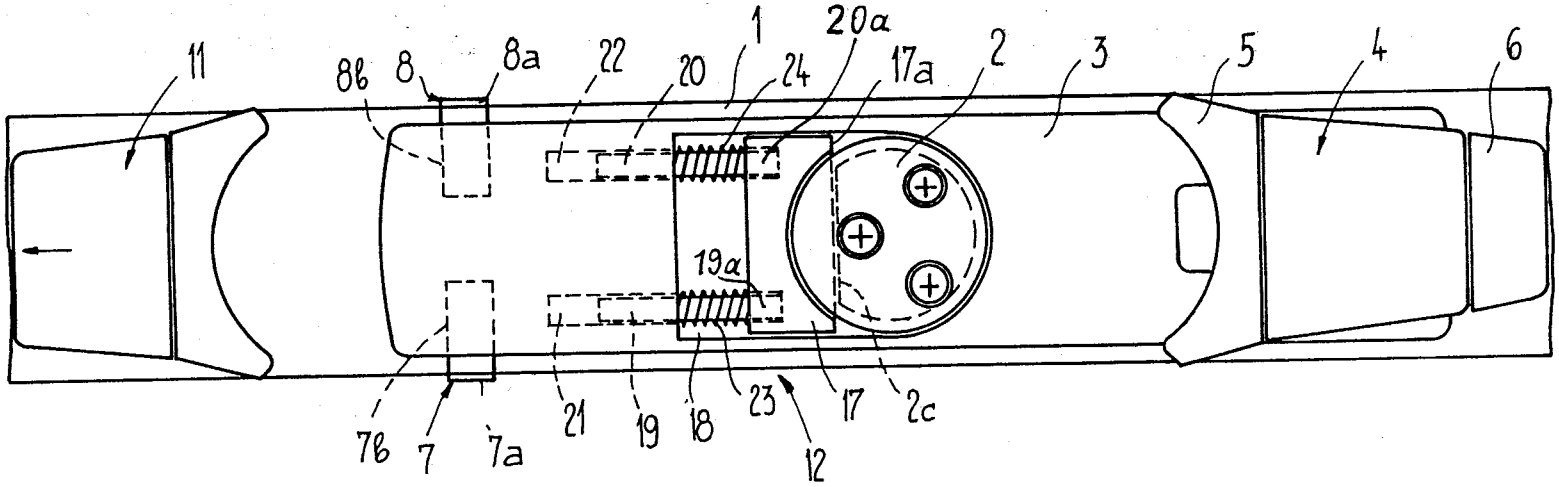
FIG. 5 depicts yet another embodiment of safety ski binding showing the release plate in its normal skiing position.

The exemplary embodiment of safety ski binding shown in FIG. 5 differs from the previously described embodiments by virtue of a different construction of the return or restoring device 12 for the release plate 3. Such return device or return means 12 possesses a slide-like configured return or restoring element 17 which is displaceably arranged in a recess 18 of the release plate 3. The return element 17 is secured at the front ends 19*a* and 20*a* of two bolts 19 and 20, respectively, extending essentially mutually parallel to one another and in the lengthwise direction of the release plate 3. These bolts 19 and 20 or equivalent structure are displaceably guided in two guide bores 21 and 22 provided in the release plate 3. The return element 17 bears upon two compression or pressure springs 23 and 24 or equivalent structure, urging the return element 17, by means of its front surface 17*a*, against a flattened portion or flat 2*c* of the pivot pin 2. Consequently, the release plate 3 is retained in its normal skiing position. In the presence of a release action, brought about by a torsional fall of the skier, aand as already explained based upon the embodiment of FIGS. 1 and 2, both the front jaw 11 and also the release plate 3 rock or pivot laterally outwards. Hence, the return or restoring element 17 is displaced back, against the force of the springs 23 and 24, by the caming action of the pivot pin 2. As soon as the ski boot has completely released from the release plate 3, then the biased or loaded springs 23 and 24 cause a return positioning of the release plate 3 back into its normal skiing position. The return element 17 further serves for length compensation during bending-through of the ski.

Apart from the illustrated solutions there are conceivable still further possibilities for constructing the return or restoring device 12. Among other things, the return device 12 also can have a leg spring, the legs of which, during rocking of the release plate 3, are tensioned or biased, and thus, cause a return setting of the release plate 3. Such proposal has been disclosed for instance in my commonly assigned, copending United States application Ser. No. 048,659, filed June 14, 1979, and entitled "Safety Ski Binding", to which reference may be readily had and the disclosure of which is incorporated herein by reference.

Figure 6:
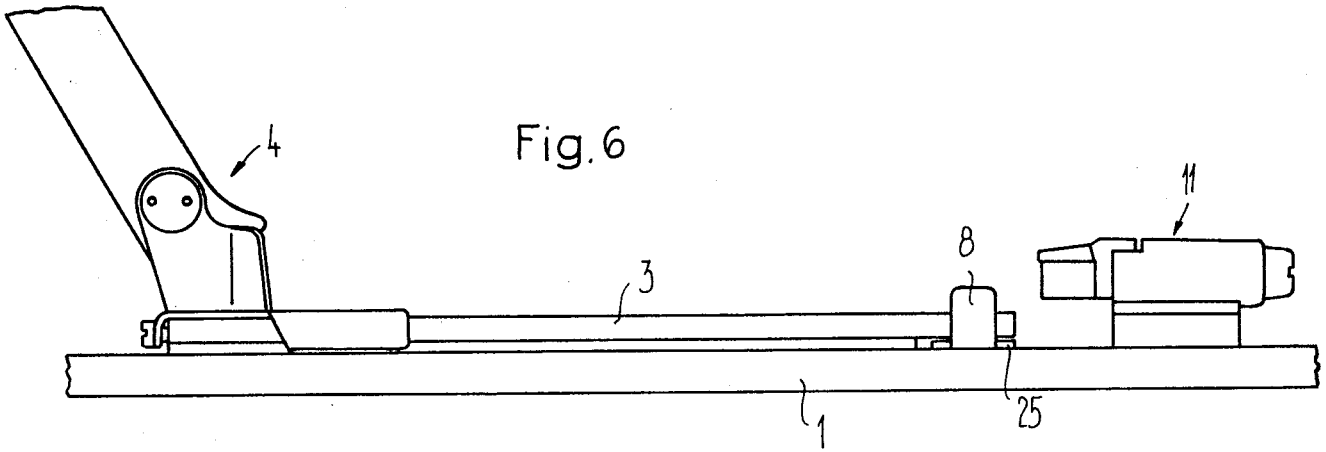
FIG. 6 is a side view of a further embodiment of safety ski binding arranged at the ski.
Figure 7:
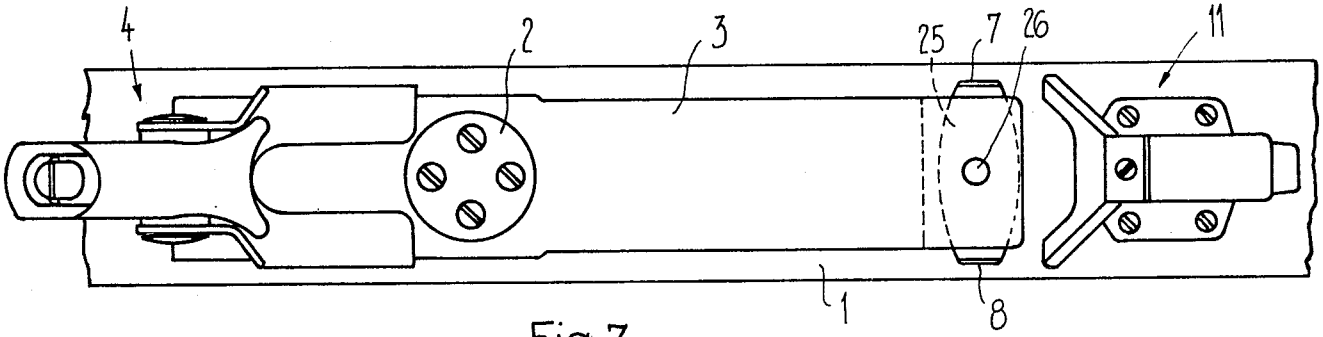
FIG. 7 is a top plan view of the embodiment of safety ski binding shown in FIG. 6.

Continuing, with the embodiment of safety ski binding shown in FIGS. 6 and 7, both the automatic heel step-in binding 4 and the likewise known front jaw 11 are of different construction than with the exemplary embodiment of FIGS. 1 and 2, but in all other respects the construction and mode of operation of this embodiment of safety ski binding is extensively similar to that of the previously described embodiments. However, in FIGS. 6 and 7, as a matter of simplification of the drawings, the return device, for returning the pivoted-out release plate 3, has not been shown. Both of the oppositely situated entrainment elements 7 and 8, protruding upwardly from the release plate 3, are interconnected by a connection web or strap 25 extending below the undersurface of the release plate 3. This connection web or strap 25 is pivotably mounted, as best seen by referring to FIG. 7, by means of a pivot pin or plug 26 or equivalent structure at the release plate 3. This connecting or connection web 25 and the entrainment elements 7 and 8 are thus pivotable about an axis extending perpendicular to the release plate 3.

Figures 8, 9, 10:
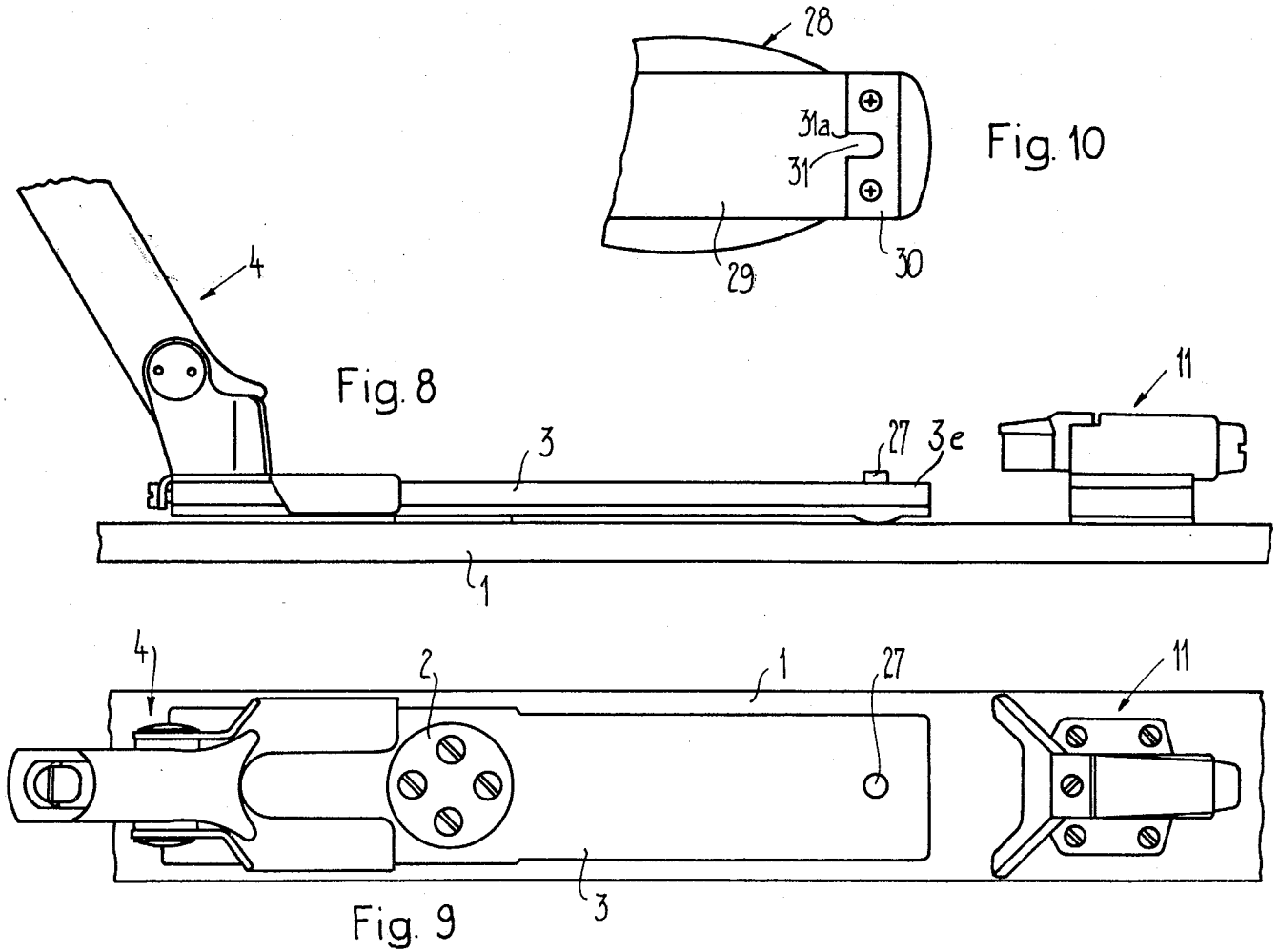
FIG. 8 is a side view of still a further construction of safety ski binding mounted at the related ski.
FIG. 9 is a plan view of the embodiment of safety ski binding shown in FIG. 8.
FIG. 10 is a fragmentary plan view of part of the sole of a ski boot which can be used with the safety ski binding illustrated in FIGS. 8 and 9.

Now with the embodiment of safety ski binding shown in FIGS. 8 and 9, which is of the same construction as the embodiment of FIGS. 6 and 7 with the exception of the entrainment arrangement, the release plate 3 is provided at its front end 3*e* with an upwardly protruding entrainment cam or dog 27 or equivalent entrainment member. This entrainment cam or dog 27 engages, when the ski boot is placed into the ski binding, into an appropriate recess provided at the ski boot sole or in a recess of a mounting or strap 30 or the like connected with the ski boot sole, as will be explained more fully hereinafter in conjunction with FIG. 10. Now as seen by referring to FIG. 10, where there is illustrated the front part of a ski boot 28 and its sole 29, the mounting or strap 30 is fastened at such ski boot sole 29, for instance is threaded or bolted thereat. This mounting or strap 30 is provided with the aforementioned recess, here designated generally by reference character 31. Recess 31 is open towards the heel of the ski boot 28, as portrayed by the opening 31*a*. An entrainment connection is established between the ski boot 28 and the release plate 3 by virtue of the entrainment cam or dog 27 engaging into the recess 31, but such entrainment connection can easily and immediately be annihilated as soon as, following a lateral release, the ski boot 28 together with the release plate 3 is laterally pivoted or rocked through a certain angle. As mentioned above, the ski boot sole 29 can be directly provided with the recess 31 for receiving the entrainment cam or dog 27.

Figure 11:
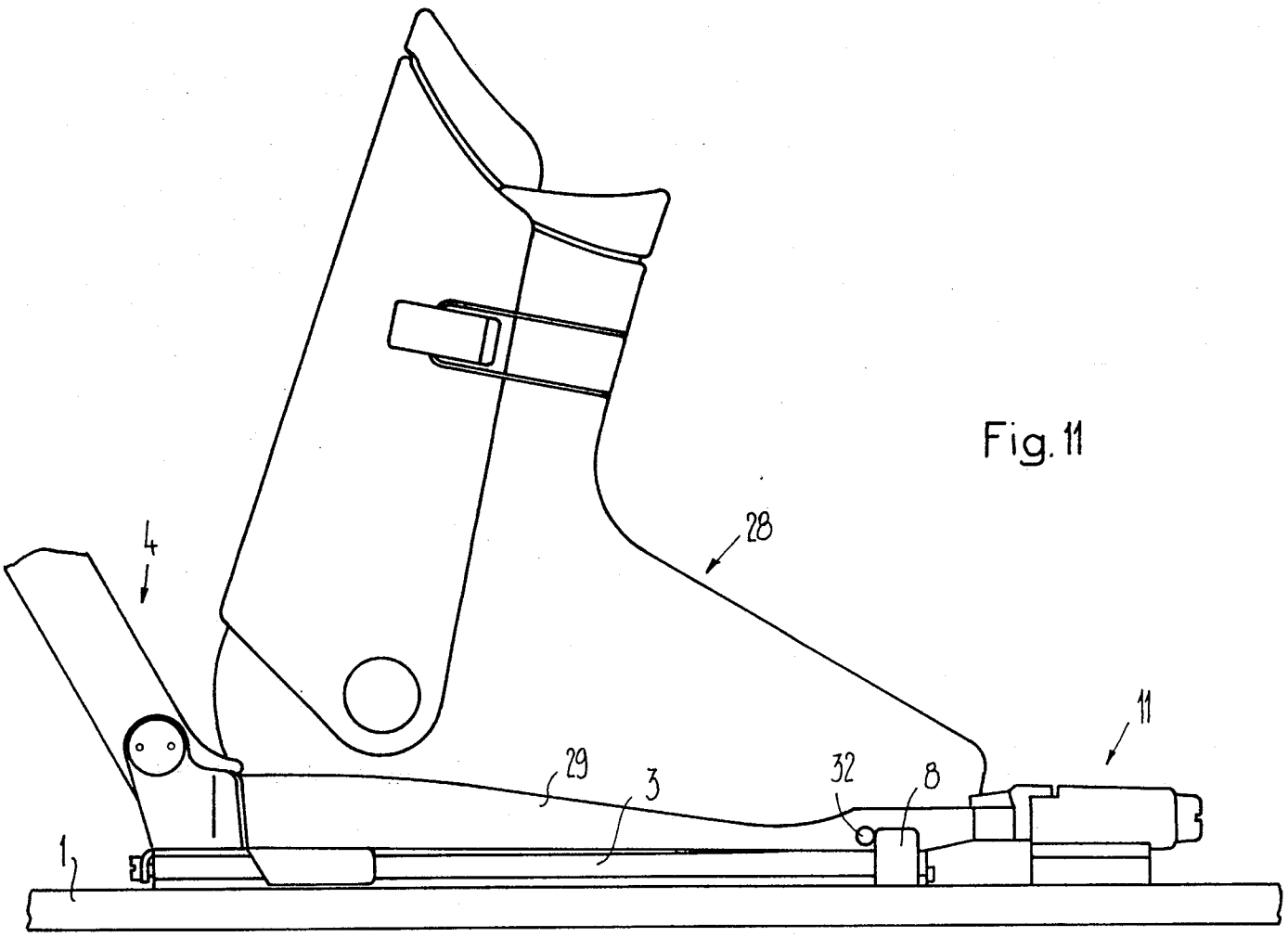
FIG. 11 illustrates in side view another embodiment of safety ski binding constructed according to the invention.

FIG. 11 illustrates a further embodiment of safety ski binding where the automatic heel step-in binding 4 and the front jaw 11, both of which are of known construction, are structured the same as for the embodiment according to FIGS. 6 and 7. However, in all other respects the variant construction of FIG. 11, as to its structure and function, corresponds to the embodiment of FIGS. 1 and 2, there having simply been omitted as a matter of convenience in illustration the showing of the return device 12 for the release plate 3. Both of the lateral entrainment elements 7 and 8, wherein in FIG. 11 only one such entrainment element has been shown, namely the entrainment element 8, are likewise laterally downwardly tiltable. At opposite sides of the sole 29 of the ski boot 28 there are attached impact elements or cams 32 or equivalent structure which protrude laterally outwardly from the ski boot sole 29. Each such impact element 32 bears against its related entrainment element 7 and 8. These impact elements 32 can be, for instance, mountings or fixtures screwed into the ski boot sole 29 or projections molded at the sole 29.

By means of such impact elements or cams 32 and the entrainment elements 7 and 8, thrust forces acting in the ski lengthwise direction at the ski boot 28, are transmitted to the ski 1. Such thrust forces can arise, for instance, during bending-through of the ski, during changes in the contact or pressure force of the automatic heel step-in binding 4, or in the presence of a torsional fall of the skier with simultaneous thrust force action.

It is possible to limit the pivotal movement of the release plate 3 by providing stops or impact members which are fixed to the ski, so as to avoid any too pronounced outward pivoting of the release plate 3.

Furthermore, it is possible, as a reversal of the illustrated exemplary embodiments, to arrange the automatic heel step-in binding fixedly at the ski, instead of at the release plate 3, and to secure the front jaw or toe holder 11 at the front end 3*e* of the release plate 3. The entrainment elements 7, 8 then would be arranged at the region of the rear end 3*d* of the release plate 3. Such solution would then differ from the exemplary embodiments illustrated and disclosed in the already mentioned United States application Ser. No. 048,659, filed June 14, 1979 in that, the entrainment elements would then have to be constructed so as to be tiltable following a release into a release position thereof, in the manner shown in conjunction with the embodiments of FIGS. 1 to 5.

With the previously mentioned solutions the spring elements, which are biased or loaded upon outward pivoting of the release plate 3 and cause a resetting of such release plate, have been mounted at the release plate 3. However, it is also conceivable to stationarily arrange such resilient or spring elements, i.e., to secure the same at the ski, and to provide for the biasing or loading of such spring elements an appropriate plug or cam or the like at the release plate 3.

Since, as already mentioned, both the automatic heel step-in binding 4 and also the front jaw or automatic toe release binding 11 are of conventional construction, it is possible to combine toe jaw-heel-bindings, which are commercially available, with the release plate 3.

Since only a slight spacing is present between the ski-fixed elements, i.e., between the pivot pin 2 and the front jaw 11, there occurs a minimum reduction in spacing or shortening between such elements by virtue of the bending-through of the ski which arises during skiing, so that the thus arising lengthwise distortions can be maintained correspondingly small.

The pivot axis of the release plate 3, defined by the pivot pin 2, is located at the region of the prolongation of the leg axis, something which is extremely desirable for safety reasons.

Since at the point in time of the lateral release of the ski binding the ski boot, by virtue of the entrainment elements, rocks along with the release plate, there is insured, just as is known for conventional plate bindings, functioning of the ski binding independently of the condition of the ski boot sole.

Furthermore, the entrainment elements 7 and 8 also can be mounted at the release plate 3 such that their mutual spacing can be changed and/or that they can be adjusted, relative to the release plate 3, in its lengthwise direction. Hence, there is possible an accommodation of these entrainment elements 7 and 8 to the width and length of the encountered ski boot. One possibility for such type construction of the entrainment elements 7 and 8 has been disclosed, by way of example, in FIGS. 4 and 5 of the previously mentioned United States Patent application Ser. No. 048,659, filed June 14, 1979.

While there are shown and described present preferred embodiments of the invention, it is to be distinctly understood that the invention is not limited thereto, but may be otherwise variously embodied and practiced within the scope of the following claims.

ACCORDINGLY,

What I claim is:

1. A safety ski binding for use with a ski comprising, in combination:

a release plate;

means for pivotably mounting the release plate at the ski for movement between a normal skiing position and a laterally pivoted position in the event that the skier suffers a torsional fall;

a heel holder for holding the heel of a ski boot used with the safety ski binding;

a sole holder for holding the sole of the ski boot;

one of said holders being capable of being fixedly arranged at the ski;

the other of said holders being secured at the release plate;

entrainment means provided for said release plate and coacting with said ski boot for releasably retaining the ski boot at the release plate;

said release plate, when in its normal skiing position, being decoupled from the ski fixed-holder and freely pivotable to both sides;

return means for resetting said release plate, after pivoting thereof, back into its normal skiing position;

said entrainment means is movably connected with said release plate;

said entrainment means being movable out of an effectual position where it releasably retains the ski boot at the release plate, following pivoting of the release plate, into a release position where it releases the ski boot from the release plate;

said entrainment means comprises at least two oppositely situated entrainment elements;

each of said entrainment elements being rotatably connected by a shaft with the release plate;

each of said entrainment elements, when in its effectual position, protruding upwardly from the release plate and bearing laterally at the sole of the ski boot; and each of said entrainment elements being tiltable about its related shaft downwardly into its release position.

2. The safety ski binding as defined in claim 1, wherein:

said release plate has opposed ends;

said other holder being arranged at one end of said release plate; and said entrainment means being arranged at the region of the other end of said release plate.

3. The safety ski binding as defined in claim 1, wherein:

each entrainment element is eccentrically mounted in the release plate and is retained in its effectual position by bearing against the ski.

4. The safety ski binding as defined in claim 1, wherein:

said release plate has a first part which is fixed to the ski and a second part which is adjustable relative to the first part in the lengthwise direction of the release plate; and said entrainment means being mounted at the adjustable second part.

5. The safety ski binding as defined in claim 1, wherein:

said entrainment elements are capable of coacting with impact elements protruding laterally from the sole of the ski boot.

6. The safety ski binding as defined in claim 1, wherein:

said return means comprises spring means which, upon outward pivoting of the release plate, is biased.

7. The safety ski binding as defined in claim 6, wherein:

said spring means is connected with the release plate.

8. The safety ski binding as defined in claim 6, wherein:

said means for pivotably mounting the release plate at the ski comprises pivot pin means;

said spring means comprising two bending spring elements fixedly retained at least at one end thereof;

said spring elements, in the normal skiing position of the release plate, bearing against oppositely situated sides of said pivot pin means and being deflected by said pivot pin means during outward pivoting of said release plate.

9. The safety ski binding as defined in claim 8, wherein:

said spring elements comprise spring rods which are clamped at both ends; and said pivot pin means comprising a substantially cylindrical pivot pin having oppositely situated flats against which bears a respective one of said spring rods.

10. The safety ski binding as defined in claim 1, wherein:

said return means comprises a displaceable return element movable against spring force;

means for exerting spring force upon said return element;

said means for pivotably mounting the release plate at the ski comprises pivot pin means;

said return element, when the release plate is in its normal skiing position, bearing at said pivot pin means; and said pivot pin means, when said release plate is outwardly pivoted, displacing the return element against said spring force.

11. The safety ski binding as defined in claim 10, wherein:

said return element is guided at said release plate.

12. The safety ski binding as defined in claim 11, wherein:

said return element is guided at a part fixed to the ski.

13. The safety ski binding as defined in claim 1, further including:

ski brake means mounted at the release plate; and said ski brake means, following release of the ski boot from the release plate and after return of the release plate into its normal skiing position, shifting from a ski brake-skiing position into a braking position.

* * * * *